US010278505B2

(12) United States Patent
Chen

(10) Patent No.: US 10,278,505 B2
(45) Date of Patent: May 7, 2019

(54) CHAIR AND CHAIR LIFTING ADJUSTMENT CONTROL MECHANISM THEREOF

(71) Applicant: ZHONGWEI HOLDING GROUP CO., LTD, Wenzhou (CN)

(72) Inventor: Qiankui Chen, Wenzhou (CN)

(73) Assignee: ZHONGWEI HOLDING GROUP CO., LTD, Wenzhou (CN)

( * ) Notice: Subject to any disclaimer, the term of this patent is extended or adjusted under 35 U.S.C. 154(b) by 67 days.

(21) Appl. No.: 15/654,753

(22) Filed: Jul. 20, 2017

(65) Prior Publication Data

US 2018/0360220 A1 Dec. 20, 2018

(30) Foreign Application Priority Data

Jun. 20, 2017 (CN) ..... 2017 1 0470766

(51) Int. Cl.

| | |
|---|---|
| ***A47C 3/22*** | (2006.01) |
| ***A47C 3/28*** | (2006.01) |
| ***A47C 3/40*** | (2006.01) |
| ***A47C 7/34*** | (2006.01) |

(52) U.S. Cl.

CPC ..... *A47C 3/22* (2013.01); *A47C 3/28* (2013.01); *A47C 3/40* (2013.01); *A47C 7/34* (2013.01)

(58) Field of Classification Search

CPC .. A47C 3/22; A47C 3/24; A47C 3/245; A47C 3/28; A47C 3/40; A47C 7/34

See application file for complete search history.

(56) References Cited

U.S. PATENT DOCUMENTS

| | | | | |
|---|---|---|---|---|
| 5,080,434 A * | 1/1992 | Locher | A47C 1/03216 | 297/300.3 |
| 6,213,552 B1 * | 4/2001 | Miotto | A47C 1/03238 | 297/300.5 |
| 6,425,636 B2 * | 7/2002 | Chen | A47C 3/30 | 297/344.19 |
| 6,588,843 B1 * | 7/2003 | Ebenstein | A47C 1/03238 | 297/300.1 |
| 7,198,329 B1 * | 4/2007 | Larson | A47C 3/22 | 248/157 |
| 8,172,324 B2 * | 5/2012 | Golynsky | A47C 1/03266 | 297/300.2 |

FOREIGN PATENT DOCUMENTS

CN 101803834 A 8/2010

* cited by examiner

*Primary Examiner* — Philip F Gabler
(74) *Attorney, Agent, or Firm* — Mark M. Friedman

(57) ABSTRACT

The present invention provides a chair and a chair lifting adjustment control mechanism thereof. The chair lifting adjustment control mechanism comprises a base, an executing member slidably connected to the base for pressing a pushbutton of a telescoping member, and a cable-driven assembly with one end connected to the executing member to enable the executing member to produce a horizontal displacement. The cable-driven assembly comprises a dragline with one end connected to the executing member, and the executing member has a driving ramp for facing the pushbutton and pressing or relaxing the pushbutton during the horizontal displacement.

14 Claims, 8 Drawing Sheets

A-A

CHAIR AND CHAIR LIFTING ADJUSTMENT CONTROL MECHANISM THEREOF

TECHNICAL FIELD

The present invention relates to office chair accessories, and in particular to a chair and a chair lifting adjustment control mechanism thereof.

BACKGROUND ART

The current office chairs are generally given the feature of ascending and descending. For instance, the patent document with its publication number CN101803834A discloses an office chair with a rotatable chair plate. The office chair is composed of a chair plate, a back plate and a leg frame, wherein a chassis is arranged at the bottom of the chair plate, a telescoping member is arranged between the chassis and the leg frame, a chair height adjustment rod is arranged on one side of the chassis and also arranged on the chassis through a rotating shaft, and the other end of the chair height adjustment rod is in compression contact with a telescoping rod of the telescoping member.

The locking and unlocking states of the telescoping member are controlled by rotating the chair height adjustment rod. When a pressure is exerted on the chair plate, the chair height adjustment rod is raised up and the chair body descends; the chair height adjustment rod is released when the desired height is reached by adjustment; the chair body is fixed at the current position since there is a compression effect between the chair height adjustment rod and the telescoping rod of the telescoping member. In the absence of the pressure, the chair height adjustment rod is raised up and the chair body ascends; the chair height adjustment rod is released when the desired height is reached by adjustment, and the chair body is fixed at the current position.

SUMMARY OF THE INVENTION

It is an object of the present invention to provide a chair lifting adjustment control mechanism. An executing member is driven by a cable-driven assembly to move horizontally, and presses a pushbutton such that a telescoping member is in an unlocking or locking state to adjust the lifting of the chair.

The above technical object of the present invention is achieved through the following technical solution: a chair lifting adjustment control mechanism comprises a base, an executing member slidably connected to the base for pressing a pushbutton of a telescoping member, and a cable-driven assembly with one end connected to the executing member to enable the executing member to produce a horizontal displacement; the cable-driven assembly comprises a dragline with one end connected to the executing member, and the executing member has a driving ramp for facing the pushbutton and pressing or relaxing the pushbutton during the horizontal displacement.

The base is used for connection with a chair plate, and the bottom part of the telescoping member is connected with a support base for abutting against the ground. The executing member is driven by the cable-driven assembly to move horizontally, and the driving ramp of the executing member abuts against the pushbutton to overcome the restoring force of the pushbutton and presses the pushbutton such that the telescoping member is in an unlocking state; at this moment, a pressure is exerted on the chair plate and thus the chair plate descends; The chair plate ascends in case of no pressure. When the desired height is reached by adjustment, the cable-driven assembly is released such that it no longer applies any force to the executing member, and the pushbutton is reset to make the telescoping member enter a locking state.

Further, the base is provided thereon with a limiting base, the limiting base has a limiting cavity, at least a part of the executing member is located within the limiting cavity and the executing member has a limiting part for restricting disengagement of the executing member from the limiting base under the effect of the cable-driven assembly.

Further, the limiting cavity has a greater height than that of the executing member, and one end of the executing member is rotated towards the pushbutton under the effect of the cable-driven assembly to press the pushbutton.

As such, the gravity of the executing member, on the one hand, partially acts upon the pushbutton, and the restoring force of the pushbutton can be overcome by reducing the acting force of the cable-driven assembly upon the executing member; and on the other hand, rotation of one end of the executing member towards the pushbutton can also remedy the drawback that the driving travel of the ramp is not enough to press down the pushbutton, and accordingly the volume of the executing member can be reduced, resulting in a more compact structure.

Further, one end at the bottom of the limiting cavity close to the pushbutton is provided with a guiding ramp.

This better facilitates rotation of the executing member towards the pushbutton.

Further, the cable-driven assembly comprises a housing fixed with the base and a rotating member rotatably connected with the housing, and one end of the dragline far away from the executing member is connected with the rotating member.

By rotating the rotating member, the dragline is wound around the rotating member, so as to pull the executing member to move.

Further, the rotating member is cylindrical, a slot as well as a seating groove communicated with the slot and running outwards through the peripheral wall of the rotating member are arranged on the end surface of the rotating member along an axial direction thereof, and a connecting post inserted into the slot is fixed at one end of the dragline far away from the executing member.

And this contributes to connection of the dragline with the rotating member.

Further, a receiving groove for receiving the dragline is arranged on the peripheral wall of the rotating member along a circumferential direction thereof, and the receiving groove is communicated with the seating groove.

As such, the spacing between the peripheral wall of the rotating member and the housing can be shortened, resulting in a more compact structure.

Further, at least a positioning notch is arranged on the sidewall of the rotating member, an elastic clamp member is fixed on the housing, and when the rotating member is rotated to an extent that the elastic clamp member is engaged into the positioning notch, the executing member presses the pushbutton such that the telescoping member is in an unlocking state.

The executing member is pulled by the dragline such that the executing member and the ramp of the pushbutton mate with one another in a driving way, and consequently the pushbutton is continuously pressed to an extent that the telescoping member enters the unlocking state. At this moment, the elastic clamp member is engaged into the positioning notch. Due to the presence of the restoring force of the pushbutton, the dragline is constantly stressed and acts upon the rotating member. The acting force of the dragline is insufficient to drive the rotating member to rotate to an extent that the elastic clamp member is disengaged from the positioning notch, and it is thus ensured that the telescoping member is always in the unlocking state.

A second object of the present invention is to provide a chair lifting adjustment control mechanism. An executing member is driven by a cable-driven assembly to move in a lifting direction of the chair, and presses a pushbutton such that a telescoping member is in an unlocking or locking state to adjust the lifting of the chair.

A chair lifting adjustment control mechanism comprises a base, an executing member supported on the base for pressing a pushbutton of a telescoping member, and a cable-driven assembly for pulling the executing member to enable the executing member to move in a lifting direction of the chair and press the pushbutton; the cable-driven assembly comprises a dragline with a middle part passing through the base and one end connected to the executing member; a position on the base through which the dragline penetrates is closer to the pushbutton in the lifting direction of the chair than a junction of the dragline and the executing member.

Further, the base is provided thereon with a limiting base, the limiting base has a limiting cavity, at least a part of the executing member is located within the limiting cavity and the executing member has a limiting part for restricting disengagement of the executing member from the limiting base under the effect of the cable-driven assembly.

Further, the limiting cavity has a greater height than that of the executing member, and one end of the executing member is rotated towards the pushbutton under the effect of the cable-driven assembly to press the pushbutton.

As such, the gravity of the executing member, on the one hand, partially acts upon the pushbutton, and the restoring force of the pushbutton can be overcome by reducing the acting force of the cable-driven assembly on the executing member; and on the other hand, rotation of one end of the executing member towards the pushbutton can also remedy the drawback that the driving travel of the ramp is not enough to press down the pushbutton, and accordingly the volume of the executing member can be reduced, resulting in a more compact structure.

Further, one end at the bottom of the limiting cavity close to the pushbutton is provided with a guiding ramp.

This better facilitates rotation of the executing member towards the pushbutton.

Further, the cable-driven assembly comprises a housing fixed with the base and a rotating member rotatably connected with the housing, and one end of the dragline far away from the executing member is connected with the rotating member.

By rotating the rotating member, the dragline is wound around the rotating member, so as to pull the executing member to move.

Further, the rotating member is cylindrical, a slot as well as a seating groove communicated with the slot and running outwards through the peripheral wall of the rotating member are arranged on the end surface of the rotating member along an axial direction thereof, and a connecting post inserted into the slot is fixed at one end of the dragline far away from the executing member.

And this contributes to connection of the dragline with the rotating member.

Further, a receiving groove for receiving the dragline is arranged on the peripheral wall of the rotating member along a circumferential direction thereof, and the receiving groove is communicated with the seating groove.

As such, the spacing between the peripheral wall of the rotating member and the housing can be shortened, resulting in a more compact structure.

Further, at least a positioning notch is arranged on the sidewall of the rotating member, an elastic clamp member is fixed on the housing, and when the rotating member is rotated to an extent that the elastic clamp member is engaged into the positioning notch, the executing member presses the pushbutton such that the telescoping member is in an unlocking state.

The executing member is pulled by the dragline such that the executing member and the ramp of the pushbutton mate with one another in a driving way, and consequently the pushbutton is continuously pressed to an extent that the telescoping member enters the unlocking state. At this moment, the elastic clamp member is engaged into the positioning notch. Due to the presence of the restoring force of the pushbutton, the dragline is constantly stressed and acts upon the rotating member. The acting force of the dragline is insufficient to drive the rotating member to rotate to an extent that the elastic clamp member is disengaged from the positioning notch, and it is thus ensured that the telescoping member is always in the unlocking state.

A third object of the present invention is to provide a liftable chair.

A chair comprises the chair lifting adjustment control mechanism.

To summarize, the present invention has the following benefits: the executing member is driven by the cable-driven assembly to perform rotating and horizontal motions, the executing member and the ramp of the pushbutton mate with one another in a driving way to press the pushbutton, and accordingly the volume of the executing member can be reduced, resulting in a more compact structure.

REFERENCE NUMERALS

1. Base; 11. Base plate; 111. Second mounting hole; 112. Third mounting hole; 12. Fixed shaft; 13. Mounting plate; 131. First mounting hole; 2. Elastic reset mechanism; 21.

Pull rod; 22. Driving nut; 23. Knob; 24. Driving piece; 25. Compression spring; 26. Limiting head; 27. Corrugated tube; 3. Telescoping member; 31. Pushbutton; 4. Executing member; 41. Driving ramp; 42. Limiting part; 43. Cylindrical groove; 44. Side groove; 45. Connecting ball; 51. L-shaped mounting base; 511. T-shaped groove; 52. Slider; 521. T-shaped part; 53. Reset spring; 61. Housing; 611. Movable opening; 612. Strip-shaped groove; 62. Rotating member; 621. Slot; 622. Seating groove; 623. Receiving groove; 624. Positioning notch; 63. Dragline; 64. Protective tube; 65. Mounting shaft; 651. Ring groove; 66. Elastic ring; 67. Connecting post; 68. Dialing piece; 681. Shielding cover; 69. Elastic clamp member; 691. Bulge; 7. Limiting base; 71. Limiting cavity; 711. Guiding ramp; 8. Guide wheel.

DETAILED DESCRIPTION OF THE INVENTION

The present invention will be further described below in details in conjunction with the accompanying drawings.

The specific embodiments are for explaining the present invention only, rather than limitations thereto. Upon reading of this specification, those skilled in the art could make amendment, which offers no creative contributions, to these embodiments as required. Yet the amendment shall fall under the protection of the patent law as long as it is within the scope of the claims of the present invention.

Embodiment 1

Figure 1:
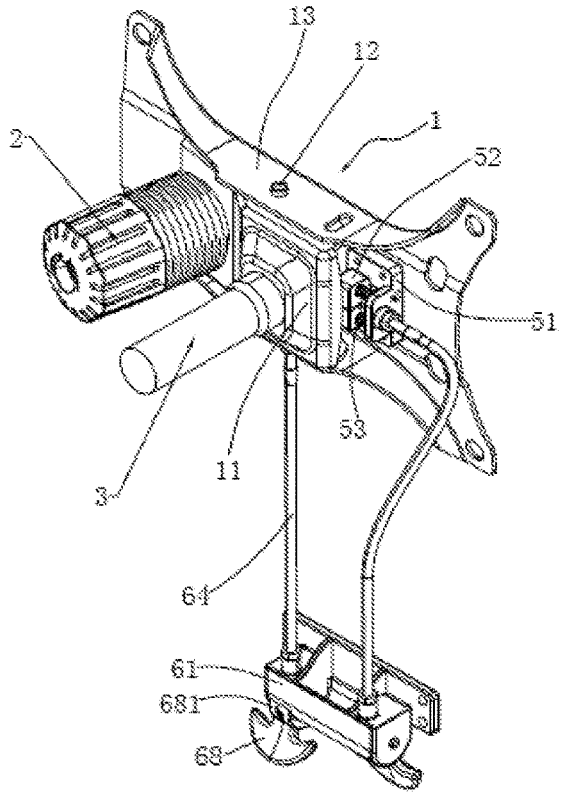
FIG. 1 is a structural view of embodiment 1.
Figure 2:
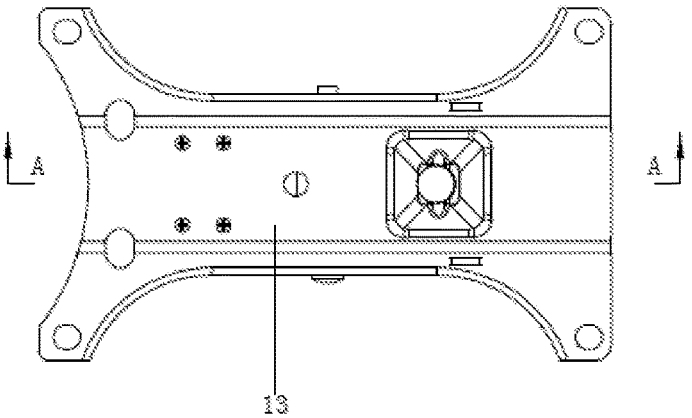
FIG. 2 is a top view of embodiment 1 with a cable-driven assembly removed.

A chair lifting adjustment control mechanism, as illustrated in FIG. 1, comprises a base 1, a telescoping member 3 fixed below the base 1, and a control mechanism for controlling unlocking and locking of the telescoping member 3.

As shown in FIG. 1, the base 1 comprises a base plate 11, a fixed shaft 12 fixed in the middle part of the base plate 11, and a mounting plate 13 sheathed on the fixed shaft 12 to be rotatable relative to the base plate 11. An elastic reset mechanism 2 is connected between the base plate 11 and the mounting plate 13, this elastic reset mechanism 2 is located on one side of the fixed shaft 12, and arranged on the other side of the fixed shaft 12 is a limiting mechanism that restricts relative rotation of the mounting plate 13 and the base plate 11.

Figure 3:
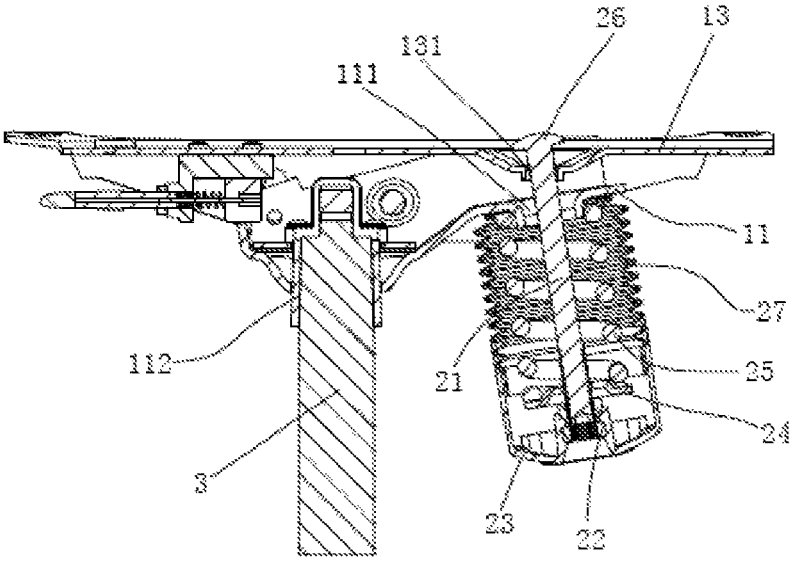
FIG. 3 is a sectional view of A-A in FIG. 2.
Figure 4:
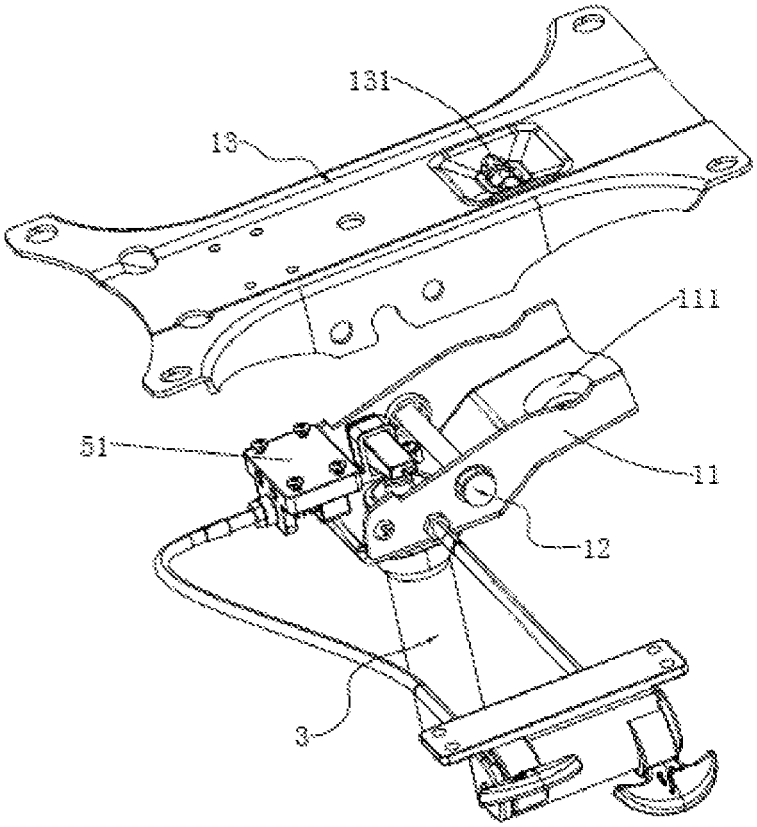
FIG. 4 is an exploded structural view of embodiment 1.

As shown in FIG. 3, the mounting plate 13 is provided thereon with a first mounting hole 131, and the base plate 11 is provided thereon with a second mounting hole 111. The elastic reset mechanism 2 comprises a pull rod 21 which penetrates out of the base plate 11 through the first mounting hole 131 and the second mounting 111 simultaneously, a driving nut 22 which is in threaded connection with the pull rod 21 and also far away from the end of the first mounting hole 131, a knob 23 which is fixed outside of the driving nut 22, a driving piece 24 which is sheathed on the pull rod 21 and a lower end surface of which abuts against the driving nut 22, a compression spring 25 two ends of which abut against the base plate 11 and an upper end surface of the driving piece 24 respectively, and a corrugated tube 27 two ends of which abut against the base plate 11 and the knob 23 respectively. A limiting head 26 is fixed on one end of the pull rod 21 penetrating out of the first mounting hole 131, the limiting head 26 is larger than the first mounting hole 131, and the pull rod 21 has a diameter that is larger than the sizes of the first mounting hole 131 and the second mounting hole 111. As a result, the pull rod 21 can undergo certain displacement relative to the first mounting hole 131 and the second mounting hole 111. The driving nut 22 is driven to rotate by rotating the knob 23. The driving nut 22 is axially moved along the pull rod 21 at the same time of its rotation, so as to push the driving piece 24 to move axially along the pull rod 21, achieving a change in the elastic force of the compression spring 25.

Figure 5:
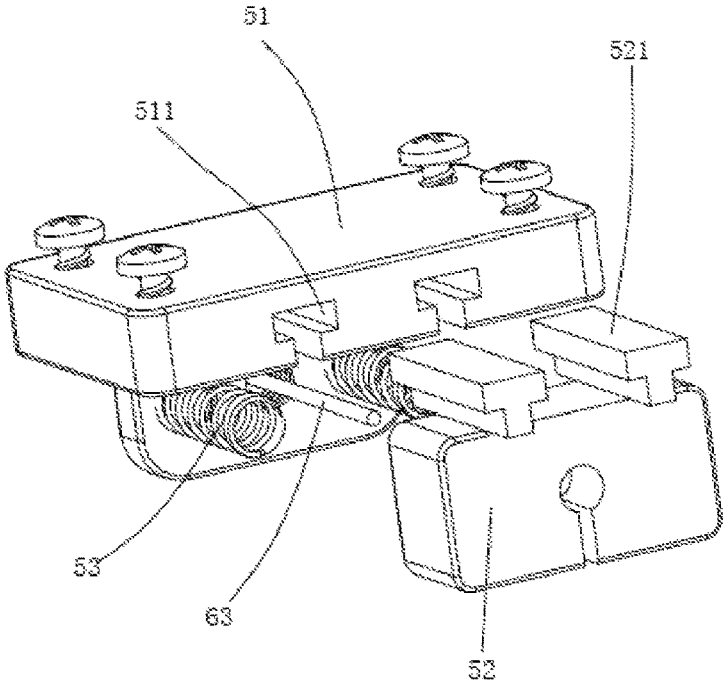
FIG. 5 is a partially exploded view of a limiting mechanism in embodiment 1.

As shown in FIG. 5, a limiting structure comprises an L-shaped mounting base 51 fixed at the bottom of the mounting plate 13, a slider 52 slidably arranged at the L-shaped mounting base 51, a reset spring 53 two ends of which are connected with the slider 52 and the L-shaped mounting base 51 respectively, and a cable-driven assembly which drives the slider 52 to move outwards against the resistance from the reset spring 53. The L-shaped mounting base 51 is provided with a T-shaped groove 511 in a length direction of the mounting plate 13. Fixed on the slider 52 is a T-shaped part 521 located within the T-shaped groove 511. When no force is exerted on the reset spring 53, the slider 52 stretches into the space between the base plate 11 and the mounting plate 13, thereby creating a restriction on the rotation of the mounting plate 13 relative to the base plate 11. The above restriction is eliminated after the cable-driven assembly drives the slider 52 to move outwards against the resistance from the reset spring 53.

Figure 6:
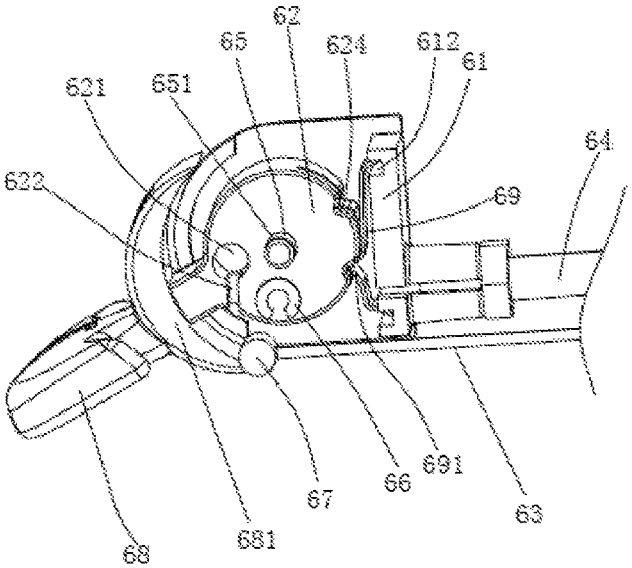
FIG. 6 is a first partially exploded view of the cable-driven assembly in embodiment 1, which mainly illustrates the connecting structure of a rotating member and a housing.

As shown in FIG. 6, the cable-driven assembly comprises a housing 61 fixed with the base plate 11, a rotating member 62, and a dragline 63. The housing 61 is fixedly connected with the base plate 11 via a protective tube 64. A mounting shaft 65 is fixed within the housing 61. The rotating member 62, which is in a cylindrical shape, is sheathed on the mounting shaft 65 and can be rotated relative to the mounting shaft 65. Only one end of the mounting shaft 65 is fixed with the housing 61, a ring groove 651 is arranged on the sidewall of the other end of the mounting shaft, and an elastic ring 66 having a recess is engaged into the ring groove 651. Disengagement of the rotating member 62 from the mounting shaft 65 is restricted by arrangement of the elastic ring 66, and the elastic ring 66 can be disengaged from the mounting shaft 65, which facilitates mounting of the rotating member 62.

Figure 7:
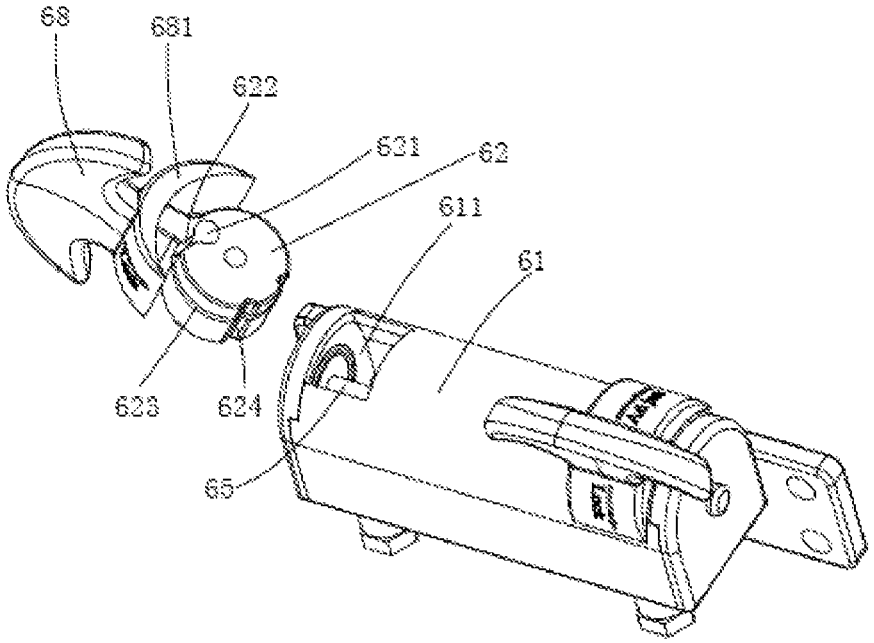
FIG. 7 is a second partially exploded view of the cable-driven assembly in embodiment 1, which mainly illustrates a movable opening on the housing and the structure of the rotating member.

As shown in FIG. 7, a slot 621 as well as a seating groove 622 communicated with the slot 621 and running outwards through the peripheral wall of the rotating member 62 are arranged on the end surface of the rotating member 62 along an axial direction thereof, a receiving groove 623 for receiving the dragline 63 is arranged on the peripheral wall of the rotating member 62 along a circumferential direction thereof, and the receiving groove 623 is communicated with the seating groove 622. As shown in FIG. 6, one end of the dragline 63 is fixedly connected with a connecting post 67, the cross section of the connecting post 67 is matched with the cross section of the slot 621 in both size and shape, the connecting post 67 is inserted into the slot 621 to connect the dragline 63 with the rotating member 62, the part of the dragline 63 that is connected with the connecting post 67 is located within the seating groove 622, and the other end of the dragline 63 is a free end that penetrates through the protective tube 64 and is then fixed with the slider 52.

As shown in FIG. 7, a dialing piece 68 is fixed on the sidewall of the rotating member 62 to facilitate its rotation, a movable opening 611 is formed on the housing 61, the dialing piece 68 stretches out of the housing 61 through the movable opening 611, and the dialing piece 68 can be rotated within the movable opening 611. A shielding cover 681 that shields the movable opening 611 is fixed on the dialing piece 68, and the shielding cover 681 always shields the movable opening 611 during the process of rotation of the dialing piece 68.

As shown in FIG. 6, two positioning notches 624 are arranged on the sidewall of the rotating member 62, two strip-shaped grooves 612 that are arranged in parallel are arranged on the housing 61, two ends of an elastic clamp member 69 are respectively engaged into these two strip-shaped grooves 612, the elastic clamp member 69 has a V-shaped bulge 691 in the middle thereof, and rotation of the rotating member 62 is restricted by clamping the bulge 691 into the positioning notches 624.

As shown in FIG. 3, the base plate 11 has a third mounting hole 112 at its bottom, the telescoping member 3 is a pneumatic rod that penetrates through the third mounting hole 112 to be fixedly connected with the base plate 11, and a pushbutton 31 of the telescoping member 3 is located within the space between the base plate 11 and the mounting plate 13.

Figure 8:
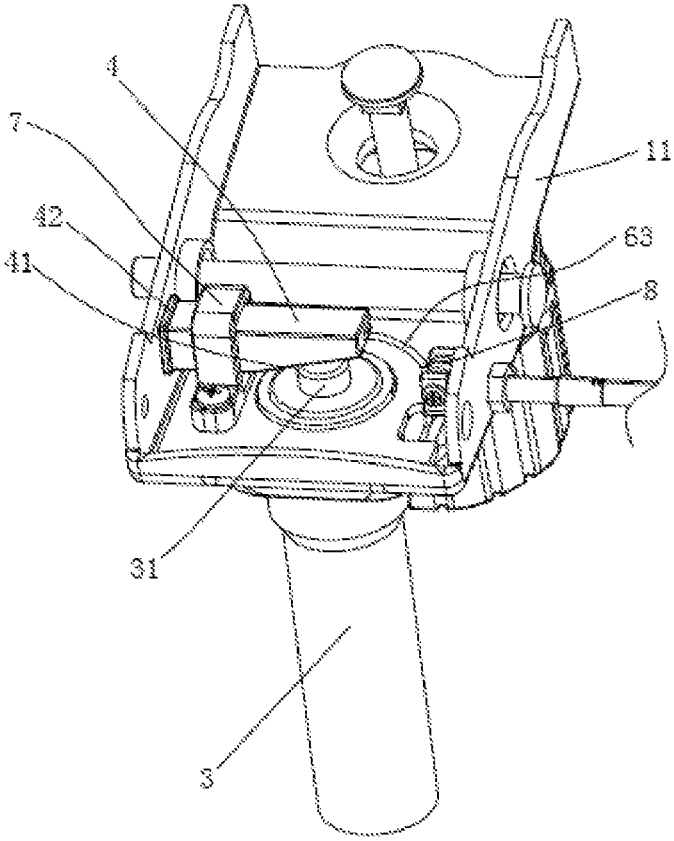
FIG. 8 is a partially structural view of a control mechanism in embodiment 1.
Figure 9:
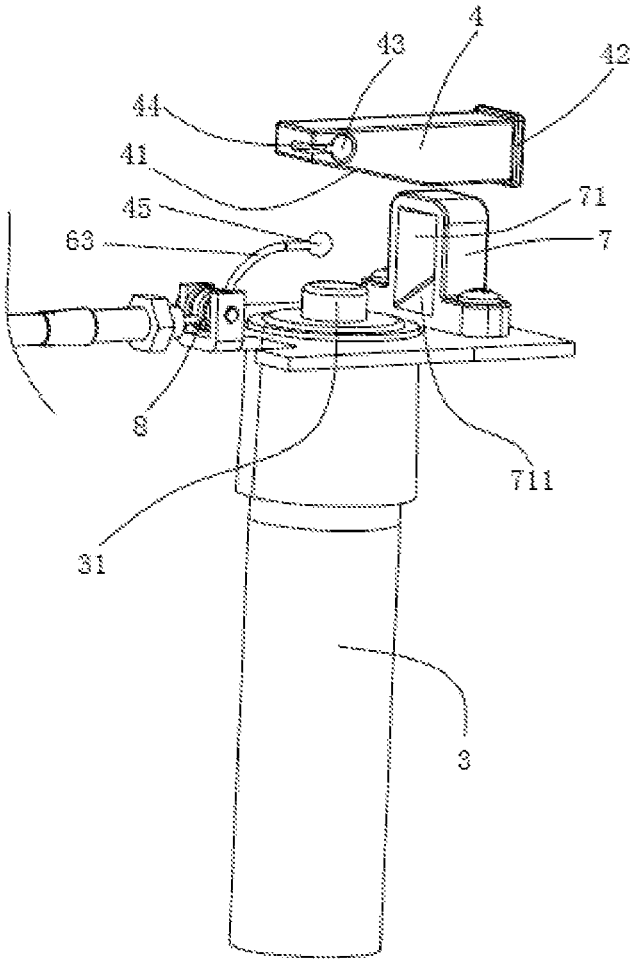
FIG. 9 is a partially exploded structural view of the control mechanism in embodiment 1, which illustrates the connection structure of the dragline and the executing member and the structure of the limiting base.

As shown in FIG. 8 and FIG. 9, the control mechanism comprises a limiting base 7 fixed on the base plate 11 and provided with a limiting cavity 71, an executing member 4 partially arranged within the limiting cavity 71, and a cable-driven assembly with one end connected with the executing member 4 to actuate movement of the executing member 4. The entire limiting cavity 71 is in the shape of a through cuboid, and a guiding ramp 711 is arranged on one side at the bottom of the limiting cavity 71 close to the pushbutton 31. The entire executing member 4 is cuboid-shaped, and the maximum height of the executing member 4 is smaller than the height of the limiting cavity 71, rendering the executing member 4 rotatable relative to the limiting base 7.

As shown in FIG. 8 and FIG. 9, a driving ramp 41 is arranged on one end surface of the executing member 4 close to the pushbutton 31, and a limiting part 42 is fixed at one end of a driving ramp 41 far away from the push button 31, and the section of the limiting part 42 is larger than the limiting cavity 71 in size. One end of the executing member 4 adjacent to the pushbutton 31 is connected with the cable-driven assembly that is structurally identical to the cable-driven assembly in the limiting mechanism, the free end of the dragline 63 of this cable-driven assembly is connected with the executing member 4, and disengagement of the executing member 4 from the limiting base 7 under the effect of the dragline 63 is prevented owing to arrangement of the limiting part 42.

As shown in FIG. 9, the free end of the dragline 63 is fixed with a connecting ball 45, and a cylindrical groove 43 having the same diameter as that of the connecting ball 45 and a side groove 44 communicated with the sidewall of the cylindrical groove 43 are arranged on the executing member 4. A guide wheel 8 is arranged on the base plate 11, and following insertion of the connecting ball 45 into the cylindrical groove 43, the dragline 63 bypasses the bottom of the guide wheel 8 through the side groove 44, and subsequently penetrates through the base plate 11 to be connected with the rotating member 62 through the protective tube 64. The distance between a position on the base plate 11 that is used for the dragline 63 to penetrate through, and the pushbutton 31 in the lifting direction of the chair is smaller than the distance between the executing member 4 and the pushbutton 31 in the lifting direction of the chair.

The mode of connection between the dragline 63 and the slider 52 in the limiting mechanism may also be the mode of connection between the dragline 63 and the executing member 4 in the control mechanism.

The mode of adjustment is as follows: the chair plate of the chair is fixed with the mounting plate 13 during installation, a backup plate connected with the chair plate is located on one side of the slider 52, and the bottom of the telescoping member 3 is connected with a support base for abutting against the ground. If it is required to adjust chair height, the dialing piece 68 is poked to drive rotation of the rotating member 62, such that the dragline 63 is wound around the rotating member 62 until the dragline 63 becomes taut. Then in the process of winding of the dragline 63, the executing member 4 is driven to rotate and move horizontally, the driving ramp 41 of the executing member 4 abuts against the pushbutton 31, and while the dragline 63 is pulled, the executing member 4 consistently presses the pushbutton 31 until the telescoping member 3 is unlocked. At this moment, the bulge 691 is engaged into the positioning notch 624 for restricting rotation of the rotating member 62. In the case of no influence from external forces, the restoring force of the pushbutton 31 for the executing member 4 is not sufficient to drive the bulge 691 to complete its disengagement from the positioning notch 624. While the telescoping member 3 is in the unlocking state, the chair plate descends when a person sits on the chair plate and thereby imposes a pressure on the chair plate. The chair plate ascends when there is no pressure. When adjustment needs to be made to reach the desired height, the dialing piece is poked until the bulge 691 is engaged into another positioning notch 624, and at this moment the dragline 63 is in a relaxed state, the executing member 4 is reset under the driving of the pushbutton 31, and the chair plate is fixed at the current height (the description above is related to the cable-driven assembly in the control mechanism).

When the dialing piece 68 is poked to disengage the slider 52 from the space of the base plate 11 and the mounting plate 13, the reset spring 53 is compressed, and at this time the bulge 691 is engaged into one of the positioning notches 624. The mounting plate 13 can wobble back and forth relative to the base plate 11 due to the facts that the base plate 11 is in rotational connection with the mounting plate 13 and that the elastic reset mechanism 2 is arranged therebetween. The chair plate and the backup plate can wobble to a certain extent when a person sits on the chair plate and leans against the backup plate. The elastic force of the compression spring 25 can be adjusted by rotating the pushbutton 31, so as to change the amplitude of wobbling (in case that the same force is exerted). If wobbling is not desired, the dialing piece 68 is poked as the bulge 691 is engaged into another positioning notch 624. And at this time, the dragline 63 is in a relaxed state, the slider 52 is reset under the driving of the reset spring 53 and the dragline 63 becomes taut (the description above is related to the cable-driven assembly in the limiting mechanism).

Embodiment 2

Figure 10:
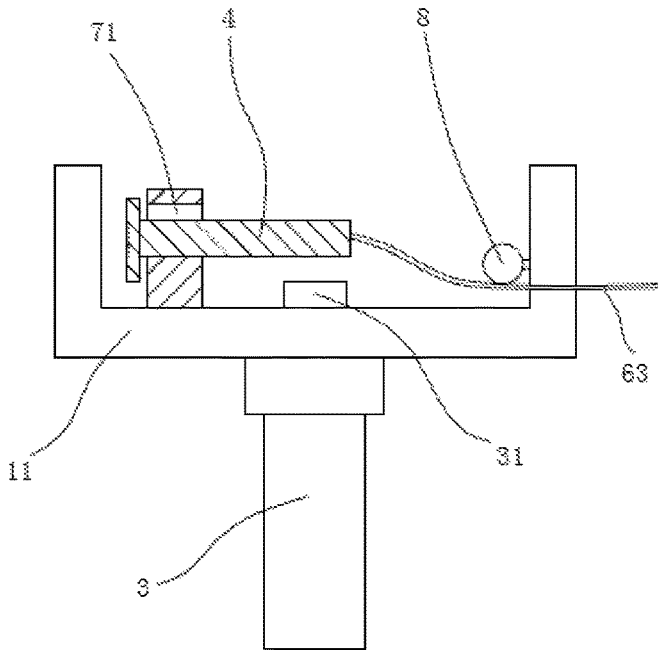
FIG. 10 is a structural view of embodiment 2.

A chair lifting adjustment control mechanism, as shown in FIG. 10, differs from that in embodiment 1 in that: the driving ramp 41 on the executing member 4 and the guiding ramp 711 at the bottom of the limiting cavity 71 are removed.

Embodiment 3

Figure 11:
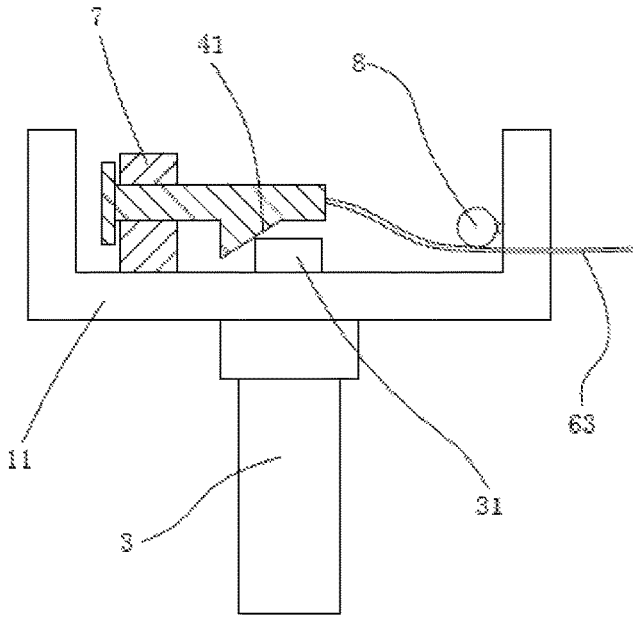
FIG. 11 is a structural view of embodiment 3.

A chair lifting adjustment control mechanism, as shown in FIG. 11, differs from that in embodiment 1 in that: the limiting cavity 71 has the same height as that of the executing member 4, the executing member 4 can only produce a horizontal displacement under the effect of the dragline 63, and also the guiding ramp 711 at the bottom of the limiting cavity 71 is removed.

Embodiment 4

A chair lifting adjustment control mechanism differs from that in embodiment 1 in that: the driving ramp 41 on the executing member 4 is removed.

Embodiment 5

A chair comprises Embodiment 1.

Embodiment 6

A chair comprises Embodiment 2.

Embodiment 7

A chair comprises Embodiment 3.

Embodiment 8

A chair comprises Embodiment 4.

The invention claimed is:

1. A chair lifting adjustment control mechanism, comprising:

a base (1), an executing member (4) slidably connected to the base (1) for pressing a pushbutton (31) of a telescoping member (3), and a cable-driven assembly with one end connected to the executing member (4) to enable the executing member (4) to produce a horizontal displacement; the cable-driven assembly comprises a dragline (63) with one end connected to the executing member (4), and the executing member (4) has a driving ramp (41) for facing the pushbutton (31) and pressing or relaxing the pushbutton (31) during the horizontal displacement, wherein the cable-driven assembly comprises a housing (61) fixed with the base (1) and a rotating member (62) rotatably connected with the housing (61), and one end of the dragline (63) far away from the executing member (4) is connected with the rotating member (62); and wherein at least a positioning notch (624) is arranged on the sidewall of the rotating member (62), an elastic clamp member (69) is fixed on the housing (61), and when the rotating member (62) is rotated to an extent that the elastic clamp member (69) is engaged into the positioning notch (624), the executing member (4) presses the pushbutton (31) such that the telescoping member (3) is in an unlocking state.

2. The chair lifting adjustment control mechanism according to claim 1, wherein the base (1) is provided thereon with a limiting base (7), the limiting base (7) has a limiting cavity (71), at least a part of the executing member (4) is located within the limiting cavity (71), and the executing member (4) has a limiting part (42) for restricting disengagement of the executing member (4) from the limiting base (7) under the effect of the cable-driven assembly.

3. The chair lifting adjustment control mechanism according to claim 2, wherein the limiting cavity (71) has a greater height than that of the executing member (4), and one end of the executing member (4) is rotated towards the pushbutton (31) under the effect of the cable-driven assembly to press the pushbutton (31).

4. The chair lifting adjustment control mechanism according to claim 3, wherein one bottom end of the limiting cavity (71) close to the pushbutton (31) is provided with a guiding ramp (711).

5. The chair lifting adjustment control mechanism according to claim 1, wherein the rotating member (62) is cylindrical, a slot (621) as well as a seating groove (622) communicated with the slot (621) and running outwards through the peripheral wall of the rotating member (62) are arranged on an end surface of the rotating member along an axial direction thereof, and a connecting post (67) inserted into the slot (621) is fixed at one end of the dragline (63) far away from the executing member (4).

6. The chair lifting adjustment control mechanism according to claim 5, wherein a receiving groove (623) for receiving the dragline (63) is arranged on the peripheral wall of the rotating member (62) along a circumferential direction thereof, and the receiving groove (623) is communicated with the seating groove (622).

7. A chair, wherein the chair comprises the chair lifting adjustment control mechanism according to claim 1.

8. A chair lifting adjustment control mechanism, comprising:

a base (1), an executing member (4) supported on the base (11) for pressing a pushbutton (31) of a telescoping member (1), and a cable-driven assembly for pulling the executing member (4) to enable the executing member (4) to move in a lifting direction of the chair and press the pushbutton (31); the cable-driven assembly comprises a dragline (63) with a middle part passing through the base (1) and one end connected to the executing member (4); a position on the base (1) through which the dragline (63) penetrates is closer to the pushbutton (31) in the lifting direction of the chair than a junction of the dragline (63) and the executing member (4);

wherein the cable-driven assembly comprises a housing (61) fixed with the base (1) and a rotating member (62) rotatably connected with the housing (61), and one end of the dragline (63) far away from the executing member (4) is connected with the rotating member (62); and wherein the cable-driven assembly comprises a housing (61) fixed with the base (1) and a rotating member (62) rotatably connected with the housing (61), and one end of the dragline (63) far away from the executing member (4) is connected with the rotating member (62); and wherein at least a positioning notch (624) is arranged on the sidewall of the rotating member (62), an elastic clamp member (69) is fixed on the housing (61), and when the rotating member (62) is rotated to an extent that the elastic clamp member (69) is engaged into the positioning notch (624), the executing member (4) presses the pushbutton (31) such that the telescoping member (3) is in an unlocking state.

9. The chair lifting adjustment control mechanism according to claim 8, wherein the base (1) is provided thereon with a limiting base (7), the limiting base (7) has a limiting cavity (71), at least a part of the executing member (4) is located within the limiting cavity (71), and the executing member (4) has a limiting part (42) for restricting disengagement of the executing member (4) from the limiting base (7) under the effect of the cable-driven assembly.

10. The chair lifting adjustment control mechanism according to claim 9, wherein the limiting cavity (71) has a greater height than that of the executing member (4), and one end of the executing member (4) is rotated towards the pushbutton (31) under the effect of the cable-driven assembly to press the pushbutton (31).

11. The chair lifting adjustment control mechanism according to claim 10, wherein one end at the bottom of the limiting cavity (71) close to the pushbutton (31) is provided with a guiding ramp (711).

12. The chair lifting adjustment control mechanism according to claim 8, wherein the rotating member (62) is cylindrical, a slot (621) as well as a seating groove (622) communicated with the slot (621) and running outwards through the peripheral wall of the rotating member (62) are arranged on the end surface of the rotating member along an axial direction thereof, and a connecting post (67) inserted into the slot (621) is fixed at one end of the dragline (63) far away from the executing member (4).

13. The chair lifting adjustment control mechanism according to claim 12, wherein a receiving groove (623) for receiving the dragline (63) is arranged on the peripheral wall of the rotating member (62) along a circumferential direction thereof, and the receiving groove (623) is communicated with the seating groove (622).

14. A chair, wherein the chair comprises the chair lifting adjustment control mechanism according to claim 8.

* * * * *